US006532617B2

(12) United States Patent
Russo

(10) Patent No.: US 6,532,617 B2
(45) Date of Patent: Mar. 18, 2003

(54) DEVICE FOR LOADING AND MAINTAINING TWO SEPARATE COLORS OF PAINT ON A PAINTBRUSH AND METHOD OF USING SAME

(75) Inventor: Peter A. Russo, Bedford, MA (US)

(73) Assignee: Plaid Enterprises, Inc., Norcross, GA (US)

( * ) Notice: Subject to any disclaimer, the term of this patent is extended or adjusted under 35 U.S.C. 154(b) by 0 days.

(21) Appl. No.: 09/843,052

(22) Filed: Apr. 26, 2001

(65) Prior Publication Data

US 2002/0157206 A1 Oct. 31, 2002

(51) Int. Cl.[7] ..... A47L 13/56
(52) U.S. Cl. ..... 15/257.05; 15/257.01
(58) Field of Search ..... 15/257.01, 257.05, 15/257.06, 104.002; 928/40.1–42.3, 98–220

(56) References Cited

U.S. PATENT DOCUMENTS

| | | | | |
|---|---|---|---|---|
| 2,969,057 | A | * | 1/1961 | Simmons |
| 3,970,396 | A | | 7/1976 | Brady |
| 4,740,384 | A | | 4/1988 | Meisner et al. |
| 4,837,062 | A | * | 6/1989 | Dunshee et al. |
| 5,153,040 | A | * | 10/1992 | Faasse |
| 5,713,095 | A | | 2/1998 | Wakat |
| 5,800,894 | A | * | 9/1998 | Navis |
| 5,871,828 | A | * | 2/1999 | Volkert |
| 5,956,802 | A | | 9/1999 | Wakat et al. |
| 5,985,395 | A | * | 11/1999 | Comstock |
| 6,012,198 | A | | 1/2000 | Thole |
| 6,022,588 | A | | 2/2000 | Wakat |
| 6,145,158 | A | | 11/2000 | Wakat et al. |

FOREIGN PATENT DOCUMENTS

| | | | |
|---|---|---|---|
| EP | 112177 | * | 6/1984 |
| JP | 8-49310 | * | 2/1996 |

* cited by examiner

*Primary Examiner*—Terrence R. Till
(74) *Attorney, Agent, or Firm*—Samuels, Gauthier & Stevens

(57) ABSTRACT

A device for loading a paintbrush with two colors of paint without mixing the colors together until the artist is ready to blend the colors during the brush strokes. The device includes a base having a pressure sensitive adhesive on one side thereof and a release liner on the adhesive. When the release liner is removed, the center portion of the base is folded together and the remaining portion of the device is applied to a substrate such as a palette or dish. A different color paint is placed on each side of the divider and a paintbrush is loaded with the two paints simultaneously.

7 Claims, 1 Drawing Sheet

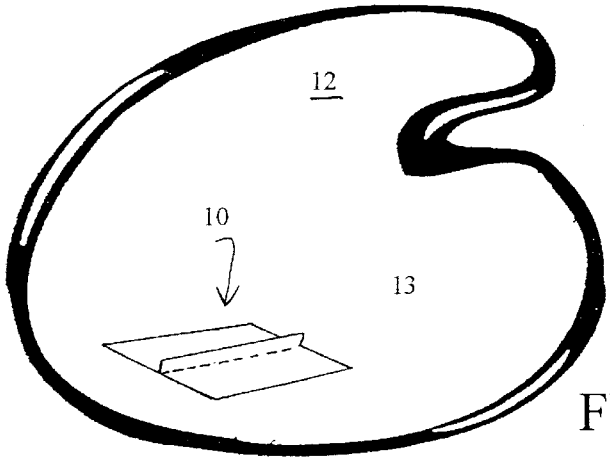
FIG. 1
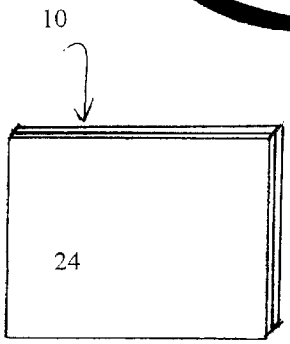
FIG. 2
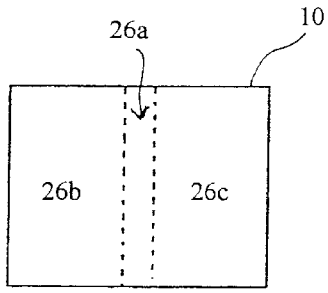
FIG. 3
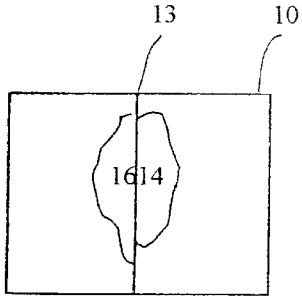
18 FIG. 4 20
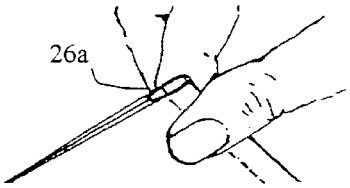
FIG. 5
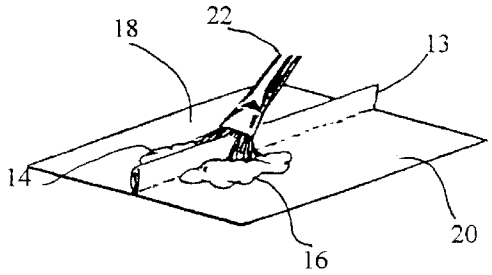
FIG. 6

DEVICE FOR LOADING AND MAINTAINING TWO SEPARATE COLORS OF PAINT ON A PAINTBRUSH AND METHOD OF USING SAME

BACKGROUND OF THE INVENTION

The invention relates to the field of painting, and in particular to filling paintbrush bristles (loading) with two colors of paint without mixing the colors together until the artist is ready to blend the colors during a brush stroke.

It is sometimes desired to fill brush bristles of a paintbrush with two different colors of paint without having the colors blend together. Typically one would place two puddles of paint onto a palette. A first corner of the paintbrush would be dipped into one of the paint colors. The second corner would be placed in the second paint color. The brush is then swept back and forth on the palette to move paint into bristles. The process of dipping and sweeping the paintbrush is continued until the bristles hold the desired amount of paint. This allows the artist to use the loaded brush for multiple strokes before having to dip the brush into paint. If the artist is not careful to sweep the brush in a straight line or dips the brush unevenly into the paint, the two colors will prematurely blend and the artist will be incapable of achieving the desired results capable of a paintbrush properly loaded with two colors of paint.

SUMMARY OF THE INVENTION

An object of the present invention is to provide a device to assist in the loading of two different colors of paint onto one paintbrush.

Another object of the present invention is to provide a double loading device that is inexpensive and easy to use.

A further object of the present invention is to provide a double loading device that will remain in position during use but is removable when a user has completed their task.

Still another object of the present invention is to provide a double loading device that is reusable with different paint colors by wiping the device clean before depositing new paint colors onto the device.

Briefly, according to the present invention, a device for double loading a paintbrush with two different colors is provided. The device includes a base having a pressure sensitive adhesive located on the bottom surface thereof and a release liner. First, the release liner is removed. The center portion of the device is folded in half such that the adhesive adheres to itself creating a dividing barrier that extends the length of the device surface. The device is then situated on a substrate by adhering the remaining adhesive surface, on each side of the barrier, to the substrate. Paint is deposited on each side of the center barrier and then a person can move a paintbrush over the center barrier, dividing the paint bristles, to load the brush with two different paint colors.

BRIEF DESCRIPTION OF THE DRAWINGS

Other objects, features and advantages of the present invention will become more apparent as the description proceeds with reference to the accompanying drawings, wherein:

FIG. 1 is a perspective view of the device according to the invention after being attached to a palette;

FIG. 2 is a perspective view of the double loading device before being applied to a substrate;

FIG. 3 is a bottom plan view of the device;

FIG. 4 is a top view of the device after the center portion is folded together and paint has been positioned thereon;

FIG. 5 is a side view of the device while being folded; and

FIG. 6 is a perspective view of the device during the paint loading.

DETAILED DESCRIPTION OF THE INVENTION

As illustrated in the figures, a device to load and maintain two separate colors of paint on a paintbrush is shown at 10. The device 10 is positioned on a support such as a palette 12 or a plate. A barrier 13 divides the device 10 in half 18,20. A different color of paint 14, 16 is placed on each half 18, 20 of the device 10. A paintbrush 22 is then loaded with paint, a different color 14, 16 on each half of the paintbrush as shown in FIG. 6. If the painter wishes to switch colors the device can be wiped clean. When the painter no longer needs the device 10, one can peel it off of the support 12.

As illustrated in FIGS. 2 and 3 is the top and bottom view of the device 10 before being applied to a palette 12. The device 10 is flat and thus is easily stored in a pile. The device 10 includes an upper layer 24 which is preferably waterproof so that the paint does not absorb into the upper surface and the device can be wiped clean and reused with new paint colors. The upper layer 24 may be a polymeric material such as polyvinyl or may be a laminate material. A pressure sensitive adhesive is applied to the bottom surface of the upper layer. The device 10 can also include a release liner 26 which is removed when the device is to be applied to the palette 12. For ease of use the release liner 26 may consist of three separate sections 26*a*, 26*b*, 26*c* as shown in FIG. 3. First, the center section of release liner 26*a* is removed. The center portion of the device is then folded in half and pinched together as seen in FIG. 5. This folded section forms a divider or barrier 13. Next the two remaining sections of release liner 26*b*, 26*c* are removed and the device 10 is applied to a substrate 12.

The device may be formed having many different dimensions including various thicknesses of the upper layer. Additionally the height of the divider or partition may vary depending on the size of the paintbrush being used. Also the adhesive may be applied to only a portion of the device such that there is enough adhesive to maintain the device in position on the palette and to form the divider. The materials of the device may vary dependent on the availability of the materials of the upper layer including the laminates and then the adhesive may change based on the ability of a particular adhesive to work with the chosen upper layer or laminate material.

Although the present invention has been shown and described with respect to several preferred embodiments thereof, various changes, omissions and additions to the form and detail thereof, may be made therein, without departing from the spirit and scope of the invention.

What is claimed is:

1. A device to load and maintain two separate colors of paint on a paintbrush, said device comprising:

a base having a top and bottom surface, wherein said base is a laminate;

a pressure sensitive adhesive on the bottom surface of said base;

a release liner, such that when the release liner is removed, the center portion of the base is folded together to create a divider and the remaining portion of the device is applied to a support surface.

2. The device according to claim 1, wherein the base is waterproof.

3. The device according to claim 1, wherein the top layer of the base is waterproof.

4. The device according to claim 1, wherein said release liner is divided into at least three sections.

5. A device to load and maintain two separate colors of paint on a paintbrush, said device comprising:

a base having a top and bottom surface, wherein said base is a laminate;

a pressure sensitive adhesive on at least a portion of the bottom surface of said base, such that the central portion of the base may be folded together to form a divider and the remaining portion of the base may be applied to a support surface, wherein paint is placed on each side of the divider and a paintbrush may be loaded with the two paints simultaneously.

6. The device according to claim 5, wherein the base is waterproof.

7. The device according to claim 6, wherein the top layer of the base is waterproof.

* * * * *